US008128541B2

(12) United States Patent
Hartman

(10) Patent No.: US 8,128,541 B2
(45) Date of Patent: Mar. 6, 2012

(54) EXERCISE GRIP DEVICE

(75) Inventor: James Hartman, Franklin, OH (US)

(73) Assignee: Grip4orce, LLC, Dayton, OH (US)

( * ) Notice: Subject to any disclaimer, the term of this patent is extended or adjusted under 35 U.S.C. 154(b) by 0 days.

(21) Appl. No.: 12/365,633

(22) Filed: Feb. 4, 2009

(65) Prior Publication Data

US 2010/0197470 A1 Aug. 5, 2010

(51) Int. Cl.
*A63B 71/00* (2006.01)
*A63B 23/16* (2006.01)
*A63B 21/02* (2006.01)

(52) U.S. Cl. ..... 482/139; 482/49; 482/122

(58) Field of Classification Search ..... 482/49, 482/106–108, 139, 122, 128; 24/499, 511, 24/20 S; 211/120; 16/411, 422, 435; 294/166, 294/148

See application file for complete search history.

(56) References Cited

U.S. PATENT DOCUMENTS

| | | | | | |
|---|---|---|---|---|---|
| 2,239,180 | A | * | 4/1941 | Kupfer | 135/72 |
| 3,326,550 | A | | 6/1967 | Melchiona | |
| 3,541,990 | A | * | 11/1970 | Du Mas | 441/69 |
| 4,588,191 | A | * | 5/1986 | Stewart | 473/256 |
| 5,415,607 | A | * | 5/1995 | Carpenter | 482/106 |
| 5,514,055 | A | | 5/1996 | Elliott | |
| 5,675,871 | A | * | 10/1997 | Webb et al. | 24/20 R |
| 5,681,243 | A | * | 10/1997 | Criss | 482/49 |
| 5,749,814 | A | * | 5/1998 | Chen | 482/93 |
| 5,947,871 | A | * | 9/1999 | Gilcrease | 482/49 |
| 6,604,789 | B1 | * | 8/2003 | Downing | 297/227 |
| 6,813,974 | B2 | * | 11/2004 | McCabe et al. | 81/64 |
| 6,898,802 | B1 | * | 5/2005 | Suarkeo | 2/20 |
| 7,494,451 | B1 | * | 2/2009 | Ramos | 482/107 |
| 7,736,284 | B1 | * | 6/2010 | Andrews | 482/108 |
| 2001/0024999 | A1 | * | 9/2001 | Pappert | 482/105 |
| 2006/0064851 | A1 | * | 3/2006 | Kincaid | 16/435 |
| 2007/0238578 | A1 | * | 10/2007 | Landfair | 482/44 |

FOREIGN PATENT DOCUMENTS

| | | |
|---|---|---|
| WO | 9625339 | 8/1996 |

OTHER PUBLICATIONS http://www.leehayward.com/heavygrips.htm, Dec. 4, 2008.
http://www.strengthcats.com/strengthequipment.htm, Dec. 4, 2008.
http://www.ihpcombat.com/store/products.php?ProductID=102, Dec. 4, 2008.

* cited by examiner

*Primary Examiner* — Allana Lewin
(74) *Attorney, Agent, or Firm* — R. William Graham

(57) ABSTRACT

An exercise grip device includes a jaw member which is of a sufficient width to permit grasping thereabout with one's hand, wherein the jaw member includes a spring aspect which is preformed to an open position to permit receiving a weight-lifting bar and is compressible to a closed position enabling engagement of the jaw member with the weightlifting bar in a manner to prevent sliding movement therebetween and while compressed exerts a force on one's hand and forearm muscles. A method includes weightlifting using the exercise grip device.

19 Claims, 4 Drawing Sheets

EXERCISE GRIP DEVICE

This is a continuation-in-part of U.S. patent application Ser. No. 12/025,163 filed Feb. 4 2008.

BACKGROUND OF THE INVENTION

1. Field of the Invention

This invention relates to an exercise device, and more specifically, to a hand exercise grip device that easily connects about and is removed from an exercise bar. Further, this invention relates generally to a method of exercising by providing a grip strengthening device on a weightlifting bar and performing weightlifting using the device to work out various muscles in one's hands, arms and torso simultaneously.

2. Related Art

Time is valuable in the field of fitness training as most people feel the need to fit the maximum amount of workout in the minimum amount of time. Trainers are often employed to aid in this regard, particularly with persons attempting to stay at peak performance and fitness.

It is felt that the grip is of a primary importance in almost every sport. However, performing specific exercises for the grip tends to take additional time which people do not usually take in lieu of cardio or bulk muscle exercises and therefore goes overlooked. There are eighteen forearm muscles to be worked to increase grip strength.

The devices which exist in the field of weightlifting relating to weightlifting bars deal principally with securing one's grip. As such, grips are typically used to aid the user in holding the equipment. A secure grip also allows the user to lift more weight and to increase the number of repetitions performed during a particular exercise. Maintaining a secure comfortable grip is thus extremely important when operating or using various free or machine weights. A secure grip is necessary to prevent accidents as a result of dropping to the exercise equipment.

There also exist exercise devices designed to help a user improve his or her grip strength and the muscles of the wrist and forearm. One such device fit within a user's hand and is squeezed by the user. Another device is a hand exerciser that has one or more springs or elastic bands attached to a base and the user applies force to stretch the springs/bands with his or her fingers.

Simple squeeze grip exercise is not the answer because the current equipment does not adequately work grip stability. Grip stability is the resistance of unwanted motion, i.e., motion caused from forces exerted from an opponent or weight lifted. It thus requires working your wrist in all planes of motion while building strong stability. Until the present invention, separate periods of exercise were required for performing exercises using weightlifting using bars and grip strength exercises. The present invention overcomes these deficiencies in the art.

SUMMARY OF THE INVENTION

It is an object to improve weightlifting.

It is another object to improve the field of exercising.

Still another object is to improve grip stability.

It is a further object to provide a device for increasing grip and forearm strength.

It is another object to provide a device which permits enhanced exercises to be performed in the art of weightlifting.

It is still another object to provide a method of weightlifting which exercises one's hand and forearm muscles during traditional weightlifting bar exercises.

Accordingly, in one embodiment, the invention is directed to an exercise grip device. The device includes a jaw member which is of a length about that the width of one's hand to permit grasping thereabout. The jaw member includes a spring element which is preformed to an open position to permit receiving a weightlifting bar. The jaw member is compressible to a closed position enabling engagement of the jaw member with the bar to prevent sliding movement therebetween and while compressed exerts a force on one's hand and forearm muscles. In a preferred embodiment, the jaw member can include an outer covering which is comprised of a polyfoam material or soft rubber and includes a spring metal formed therewith, preferably within the polyfoam material. The jaw member can be formed to have an arcuate surface and include a lengthwise opening which readily permits the bar to pass in and out therethrough. The polyfoam material can provide a comfortable grip as well as secure grip to the bar.

Another embodiment envisions the exercise grip device connected to a weightlifting bar. The exercise grip device can be removably connected or fixed to the bar. The polyfoam or rubber can serve as a pad having a first outward gripping surface and an opposing inner bar gripping surface. The polyfoam and spring can be formed from in varying amount of compressibility and spring force to accommodate user preferences. For example, rubber or polyfoam can be used. It is envisioned that as applied to a weightlifting bar, one or two exercise grip devices can be used.

A method of weightlifting which exercises one's hand and forearm during traditional weightlifting bar exercises includes the steps of (a) employing an exercise grip device having a spring force onto a weightlifting bar and grasping the exercise grip device in a manner to cause spring force to be exerted on one's hand thereby exercising one's hand and forearm muscles, and (b) concurrently lifting the bar while performing step (a) to exercise other muscles of one's body.

The present invention is a method of exercising by providing a grip strengthening device on a weightlifting bar and performing weightlifting using the device to work out various muscles in one's hands, arms and torso simultaneously. The gripping device is easily secured to the bar and can be easily removed from the bar. The gripping device can be readily lengthwise disposed to a desired position on a bar and can be used on a variety of different bars and dumbbells.

Further aspects of the invention are evident from the Detailed Description of the Preferred Embodiments and Drawings.

The exercise grip device of the present invention solves the problems associated with the prior art by providing the exercise grip device which enables multiple and concurrent exercises of the hands, arms and torso while providing a secure grip when using a weightlifting bar. The exercise grip device is portable and easily connected to and removed from an exercise bar.

DETAILED DESCRIPTION OF PREFERRED EMBODIMENTS

The invention is described in detail as preferred embodiments of the invention with the understanding that the present disclosure is to be considered as an exemplification of the principles of the invention and is not intended to limit the broad aspect of the invention to the embodiment illustrated. The exercise grip device of the present invention is generally designated by the numeral 10 and can be used in connection with a weightlifting bar 12 to provide an improved exercise method and device for performing concurrent exercises in one's hands H, arms A and torso T simultaneously. However, it is contemplated that exercise grip device 10 can be used as a stand alone piece of equipment for exercising one's hands H and forearms F. The exercise grip device 10 includes jaw members 14 which are shown here as opposing generally arc shaped members and can be formed as part of a single piece material construction. The exercise grip device 10 is of a length L about the width of one's hand to permit grasping thereabout.

Figure 2:
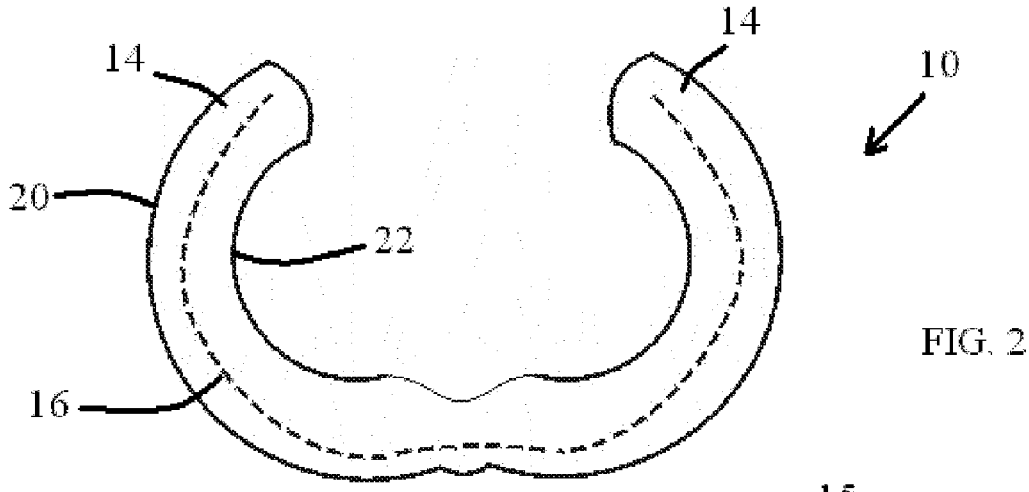
FIG. 2 is a cross-sectional view of the exercise grip device of FIG. 1 taken along the line 2-2.
Figure 1:
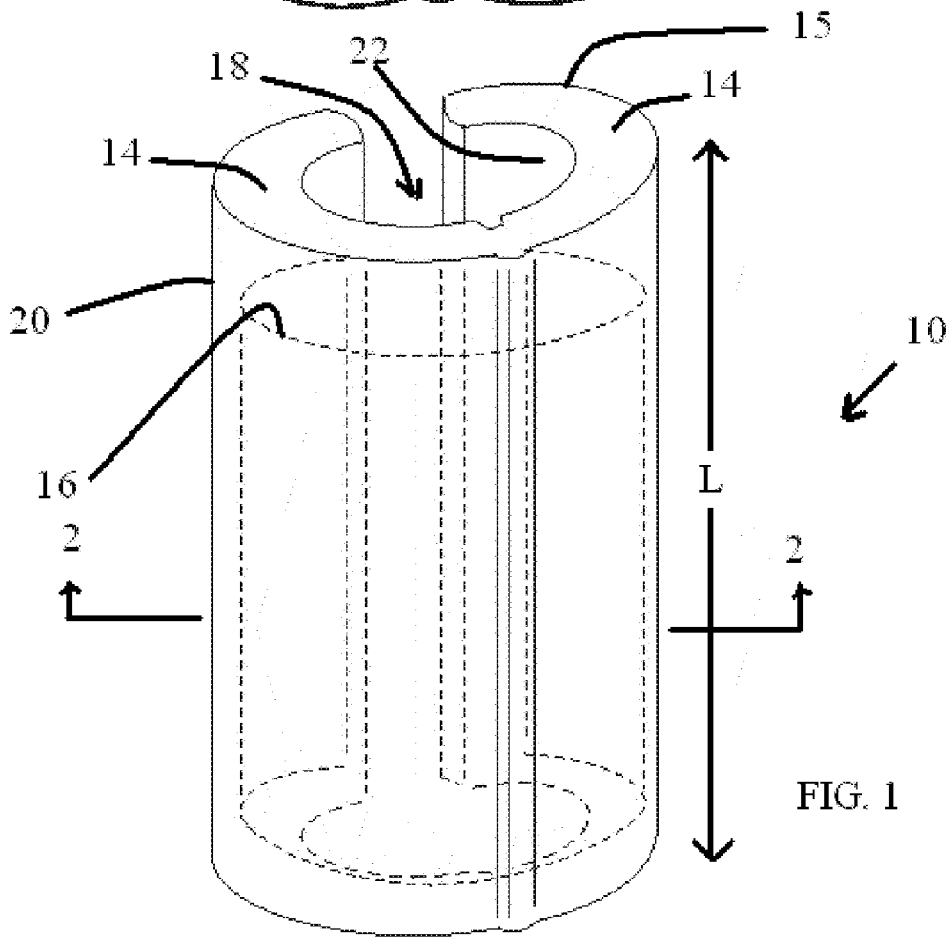
FIG. 1 is a perspective view of an embodiment of a exercise grip device of the present invention.
Figure 4:
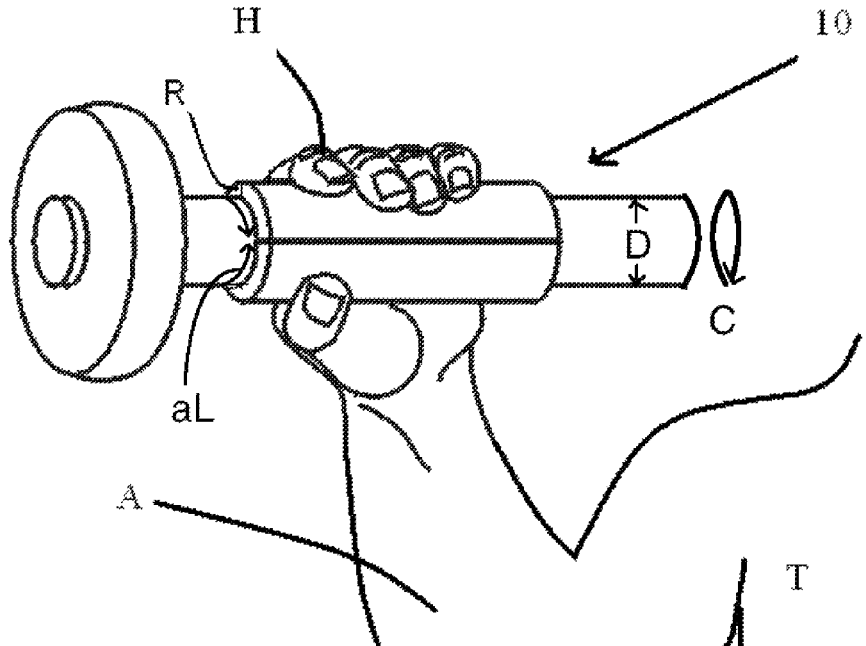
FIG. 4 is a perspective view of the exercise grip device disposed around a portion of a bar in a closed position and forced to conform with the cylindrical shape of the bar in accordance with the present invention.
Figure 3:
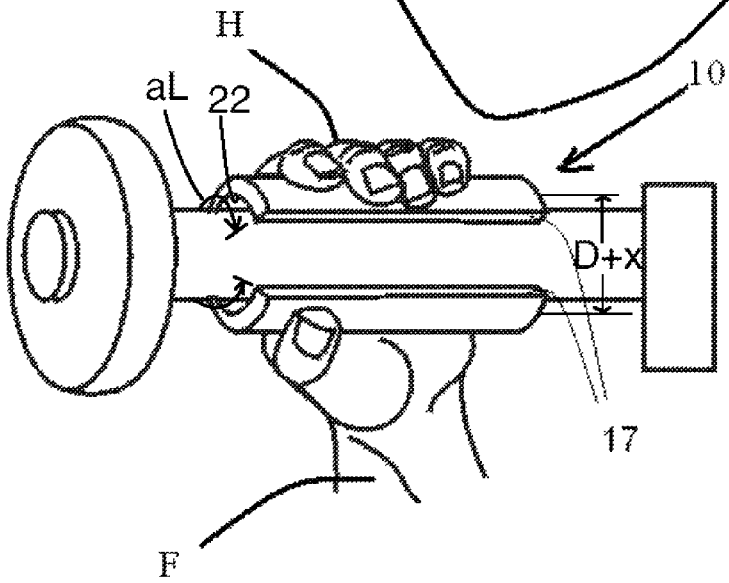
FIG. 3 is a perspective view of the exercise grip device disposed around a portion of a bar in an open position in accordance with the present invention.

The jaw members 14 can include a spring element 16 which is preformed to an open position as seen in FIG. 1-3 to permit insertion of a weightlifting bar 12 therethrough. The jaw members 14 and spring element 16 are compressible to a closed position as seen in FIG. 4 enabling engagement of the jaw members 14 with the bar 12 to prevent sliding movement therebetween. While compressed, the exercise grip device 10 exerts a force on one's hand H and forearm F muscles.

In a preferred embodiment, the jaw members 14 can comprise an outer covering 15 made of a polyfoam material and the spring element 16 can include a spring metal formed therein, preferably within the polyfoam material during a molding process. For example, the spring metal can be inserted into a mold in a manner to be held centrally such that a polyol and an isocyanate react to form a polyfoam about the spring 16. Optionally, rubber or other polymer having memory can be used to perform the invention as a single component. The jaw members 14 can be formed to have an arcuate surface or other desirable surface configuration which lends itself to weightlifting. A lengthwise opening 18 readily permits the bar 12 to pass in and out therethrough. The exercise grip device 10 can provide a comfortable grip as well as secure grip to the bar 12. The exercise grip device 10 can have an in use diameter thickness of about 2 to 3 inches which together with a conventional weightlifting bar diameter of about 1¼ inch provide a "Fat Bar" feel. Thus, when in use on bar 12 which has a diameter D of about 1 inch as seen in FIG. 4, the exercise grip device 10 includes a radial cross-section R having radial length of at least about one quarter inch thereby rendering an in use diameter thickness in conjunction with the bar of about 2 inches and a radial circumference C of about $2\Pi r$ or about 3.14 inches. Likewise, the grip device 10 has an inner radial arc length aL generally equating to the circumference C, however, in the device's relaxed open state has a relaxed inner diameter of D+x. When disposed on bar 12 without ends 17 overlapping, the grip device 10 has its inner bar gripping surface 22 substantially entirely disposed on the bar 12 and exerts a resistive force on one's hands and forearms in a manner wherein the device 10 wants to spring open to its relaxed position as seen in FIG. 3. While held in a compressed position as seen in FIG. 3, the device 10 is compressed to assume an inner diameter approximate diameter D and does so without the ends of jaw members 14 interfering with each other to permit gripping surface 22 assuming position on bar 12 as described above. It is recognized that the thickness can be varied to accommodate user preference.

One embodiment of the invention envisions the exercise grip device 10 connected to a weightlifting bar 12. The exercise grip device 10 can be removably connected or fixed to the bar 12. The outer covering 15 can serve as a pad having an outward gripping surface 20 and an opposing inner bar gripping surface 22. The outer covering 15 can be textured for functional an aesthetic purposes. The outer covering 15 and spring 16 can be formed from in varying amount of compressibility and spring force to accommodate user preferences. For example, rubber or polyfoam can be used. It is envisioned that as applied to a weightlifting bar 12, one or two exercise grip devices 10 can be used.

A method of weightlifting which exercises one's hand and forearm during traditional weightlifting bar exercises includes the steps of (a) employing an exercise grip device having a spring force onto a weightlifting bar and grasping the exercise grip device in a manner to cause spring force to be exerted on one's hand thereby exercising one's hand and forearm muscles, and (b) concurrently lifting the bar while performing step (a) to exercise other muscles of one's body.

Figure 5:
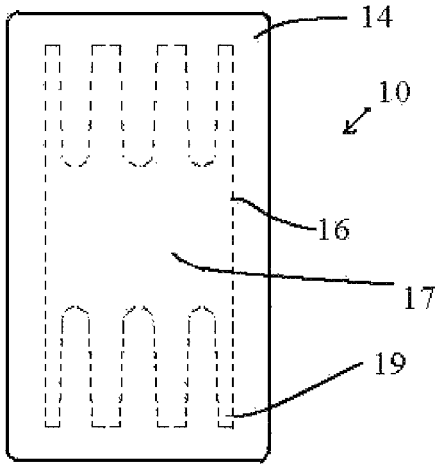
FIG. 5 is top view of another embodiment of the invention.
Figure 6:
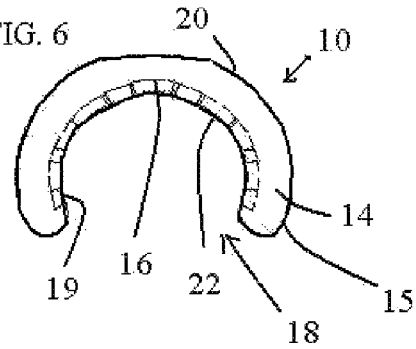
FIG. 6 is an end view of the embodiment in FIG. 5.
Figure 7:
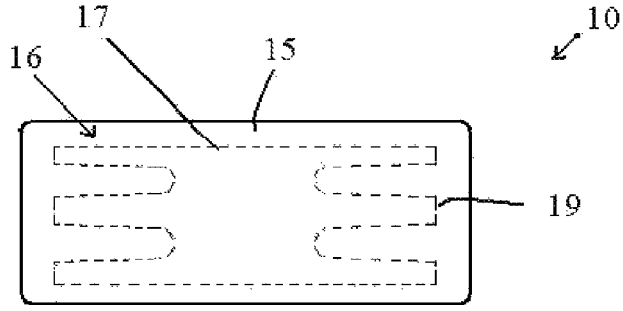
FIG. 7 is a side view of the embodiment of FIG. 5.
Figure 10:
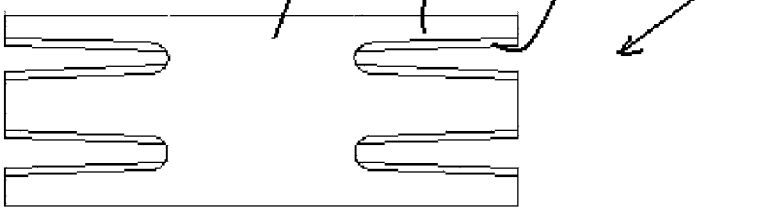
FIG. 10 is a side view of the embodiment of FIG. 5.
Figure 8:
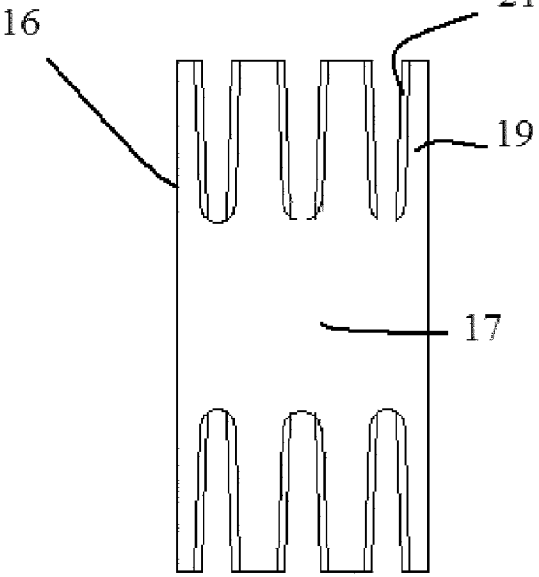
FIG. 8 is top view of a part of the embodiment in FIG. 5.
Figure 9:
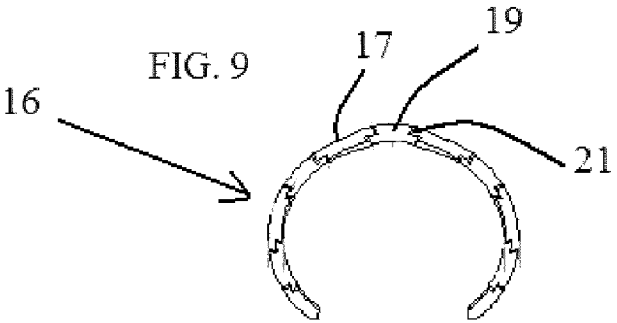
FIG. 9 is an end view of the embodiment in FIG. 5.

The embodiment seen in FIGS. 5-7 modify the spring element 16 into a skeleton having a spine 17 and appendages 19. The appendages 19 include a recessed surface 21 which aids for a self retaining mechanism to keep the spring element 16 in position in its surrounding molded covering 15. In the case where element 16 is molded to be partially exposed this feature is exemplified. However, the element 16 can be recessed within the covering 15. FIGS. 8-10 show the skeleton 16 with spine 17 and appendages 19 having recessed surfaces 21 to aid in retaining the element 16 in place. Further, the skeleton element 16 provides for not only strength but also flexibility in the overall product and enables a various materials to be employed to carry out this aspect such as nylon or polymer blend or spring steel, for example.

By employing the instant invention, the problem of developing proper grip stability is better achieved. The invention provides for enhanced development of grip stability, grip, wrist, elbow, shoulder, chest and latissimus dorsi. A benefit of the invention is that the enhanced grip stability and overall strength will lead to better endurance and decreased fatigue which would otherwise be caused by high levels of lactic acid which provide hydrogen ions causing the forearm to shut down.

While specific embodiments have been illustrated and described, numerous modifications come to mind without markedly departing from the spirit of the invention. The invention covers a tube-like member having an opening running axially lengthwise wherein the tube-like member can be formed with a spring material and take on geometric shapes which are suitable for practicing the invention. The scope of protection is thus only intended to be limited by the scope of the accompanying claims. Thus, the breadth and scope of the present invention should not be limited by any of the above described exemplary embodiments, but should be defined only in accordance with the following claims and their equivalents.

What is claimed is:

1. An exercise grip device, which includes:

a generally C-shaped tube-like member with a lengthwise opening defined between two ends and wherein said member has a width to permit grasping thereabout with one's hand and said tube-like member includes a spring having at least one opening therein which is preformed to an open position having a relaxed inner diameter and is compressible to a closed position to exert a force on one's hand and arm muscles and which includes an outer covering comprising non-metal, wherein when said grip device is in the closed position engages a bar without interference by said ends such that said C-shaped tube-like member ends are adjacent one another and said tube-like member assumes an inner diameter of about an inch which is substantially less than the relaxed inner diameter which is about a diameter of the bar to prevent sliding movement therebetween by virtue of said outer covering to bar contact of said grip device with the bar and while engagable by one's hand in a continuous compressed manner prevents sliding movement through said outer covering to bar contact and concurrently works one's arm muscles throughout exercise employing said device in such manner.

2. The exercise grip device of claim 1, wherein said tube-like member includes a spring formed within said outer covering.

3. The exercise grip device of claim 1, wherein in said open position readily permits the bar to pass in and out therethrough.

4. The exercise grip device of claim 2, wherein said spring is formed within said outer covering and generally spans therethrough to provide resistance.

5. The exercise grip device of claim 1, wherein said exercise grip device is connected to a weightlifting bar.

6. The exercise grip device of claim 1, wherein said outer covering forms a pad having an outward gripping surface.

7. The exercise grip device of claim 6, wherein said outer covering has an inner bar gripping surface opposing said outward gripping surface wherein said inner gripping bar surface has an arc length which is generally equal to a radial circumference of the bar.

8. The exercise grip device of claim 1, wherein said outer covering includes one of a smooth and textured surface.

9. The exercise grip device of claim 5, wherein the weightlifting bar includes a diameter of about an inch such that when said exercise device is operably disposed thereabout in a completely engaged manner provides an in use outer diameter thickness of about 2 to 3 inches to provide a "Fat Bar" feel.

10. An exercise grip device, which includes:

a tube-like member with a lengthwise opening defined between two ends and wherein said member has a width to permit grasping thereabout with one's hand and said tube-like member includes a spring having at least one opening therein which is preformed to an open position having a relaxed inner diameter to readily receive a weightlifting bar having a given handle bar outer diameter and is compressible to a closed position such that when so disposed on the weightlifting bar said ends are adjacent one another and said tube-like member assumes an inner diameter approximately that of said given handle bar outer diameter such that said grip device has an inner non-metal bar gripping surface substantially entirely disposed on the weightlifting bar without interference by said ends enabling engagement of said tube-like member with the weightlifting bar and while so engaging the weightlifting bar by one's hand in a continuous compressed manner prevents sliding movement through said inner non-metal bar gripping surface to bar contact and concurrently works one's hand and arm muscles by exerting outward force on one's hand and in turn on one's arm muscles throughout exercise employing said grip device in such manner.

11. The exercise grip device of claim 10, wherein said inner bar gripping surface includes an inner concave surface including one of rubber and polyfoam.

12. The exercise grip device of claim 10, wherein said tube-like member includes an outer covering including one of rubber and polyfoam.

13. The exercise grip device of claim 10, wherein said tube-like member includes a lengthwise opening which readily permits the bar to pass in and out therethrough.

14. The exercise grip device of claim 10, wherein said spring generally spans through said outer covering to provide resistance.

15. The exercise grip device of claim 10, wherein said exercise grip device is connected to the weightlifting bar.

16. The exercise grip device of claim 12, wherein said outer covering forms a pad having an outward gripping surface and an opposing inner bar gripping surface.

17. The exercise grip device of claim 12, wherein said outer covering includes one of a smooth and textured surface.

18. The exercise grip device of claim 10, wherein said spring includes a skeleton having openings.

19. An exercise grip device, which includes:

a tube-like member with a lengthwise opening defined between two ends and wherein said member has a width to permit grasping thereabout with one's hand and said tube-like member includes a spring having at least one opening therein which is preformed to an open position and is compressible to a closed position to exert a force on one's arm muscles and which includes an inner surface having a non-metal material which in the closed position engages a weightlifting bar having a given outer handle bar diameter to prevent sliding movement therebetween by virtue of said non-metal inner surface to bar contact of said grip device with the bar without interference by said ends such that when said tube-like member is forcibly closed said ends are adjacent one another and said tube-like member assumes an inner diameter which is approximate the outer handle bar diameter and less than the relaxed inner diameter and while so engagable by one's hand in a continuous compressed manner prevents sliding movement thorough said non metal to bar contact and concurrently works one's hand and arm muscles throughout such exercise employing said grip device in such manner.

* * * * *